US009284781B2

(12) United States Patent
Schellstede

(10) Patent No.: US 9,284,781 B2
(45) Date of Patent: Mar. 15, 2016

(54) OIL AND GAS ENHANCEMENT SYSTEM—RADIAL DRILLING METHOD

(71) Applicant: Herman Joseph Schellstede, New Iberia, LA (US)

(72) Inventor: Herman Joseph Schellstede, New Iberia, LA (US)

( * ) Notice: Subject to any disclaimer, the term of this patent is extended or adjusted under 35 U.S.C. 154(b) by 210 days.

(21) Appl. No.: 13/708,368

(22) Filed: Dec. 7, 2012

(65) Prior Publication Data

US 2013/0146362 A1 Jun. 13, 2013

Related U.S. Application Data

(60) Provisional application No. 61/630,358, filed on Dec. 9, 2011.

(51) Int. Cl.
*E21B 7/04* (2006.01)
*E21B 7/00* (2006.01)
*E21B 7/06* (2006.01)

(52) U.S. Cl.
CPC ... *E21B 7/04* (2013.01); *E21B 7/00* (2013.01); *E21B 7/046* (2013.01); *E21B 7/061* (2013.01)

(58) Field of Classification Search
CPC ..... E21B 7/065; E21B 7/061; E21B 7/04; E21B 7/046; E21B 7/06; E21B 7/18; E21B 41/0078; E21B 10/60
See application file for complete search history.

(56) References Cited

U.S. PATENT DOCUMENTS

| | | | | |
|---|---|---|---|---|
| 4,765,173 | A * | 8/1988 | Schellstede | 72/325 |
| 4,932,129 | A * | 6/1990 | Schellstede et al. | 30/358 |
| 5,183,111 | A * | 2/1993 | Schellstede | 166/298 |
| 2012/0228033 | A1 * | 9/2012 | Mazarac | 175/67 |
| 2014/0096966 | A1 * | 4/2014 | Freitag | 166/298 |

* cited by examiner

*Primary Examiner* — Yong-Suk (Philip) Ro

(57) ABSTRACT

The invention being designed in this application relates to a radial drilling method. Boreholes are placed into oil and gas formations to provide openings for the removal of the product.

Oil and gas wells extend to different depths and downhole well conditions. The radial system has been designed to accommodate the well conditions and to jet or drill different oil and gas formation. The radial system provides a mill/bit which is rotated from a downhole motor or a surface swivel. The mill ports, the steel casing, and the bit extend outward into the formation forming a borehole to a predetermined length. The borehole is provided without an entrance radius into the formation. Several radial holes can be provided considering a one trip event.

9 Claims, 12 Drawing Sheets

OIL AND GAS ENHANCEMENT SYSTEM—RADIAL DRILLING METHOD

CROSS REFERENCE TO RELATED APPLICATIONS

The application is a non-provisional, and claims priority benefit, of U.S. Patent Application Ser. No. 61/630,358 file Dec. 9, 2011 which is incorporated herein by specific reference.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO APPENDIX

Not applicable.

BACKGROUND OF THE INVENTION

1. Field of the Invention

The invention disclosed and taught herein relates to the enhancement of oil and gas wells and more specifically related to the means to provide radial boreholes into an oil and gas formation.

2. Description of the Related Art

U.S. Patent Application Publication No. 61/630,358 discloses radial drilling boreholes into a formation were as the extension requires no specific radius to transform from vertical to horizontal direction.

U.S. Patent Application Publication No. 61/630,358 discloses the detail in which the casing is parted and the boreholes are provided.

The invention disclosed and taught herein is directed to an improved system for radial drilling systems.

BRIEF SUMMARY OF THE INVENTION

The Radial Drilling System comprising of a downhole full automatic system, which can part downhole, steel casing and extend outward into an oil and gas formation. The purpose of the system is to increase the area, which is exposed to drainage of a formation. The oil and gas wells are drilled vertically or horizontally by standard means. The standard boreholes are cased with steel tubes and are cemented via the annulus between the casing and the drilled borehole. Once the cement has been installed, it is tested to determine its bond strength and coverage.

Once the well, which has been drilled, cemented and tested, the Radial Drilling System can be employed. The location of the radial holes is determined by an engineering study employing specific instruments which locate the area of interest and defines the measurements of the oil and gas potential. The engineering logs indicate the area of interest as measured from a surface benchmark.

The casing string is coupled via threaded joints, which are larger than the casing body. The coupling locations are illustrated on a collar log. The collar log illustrates the location of the collar with relation to a measurement from the surface. Prior to performing this radial drilling process, the casing is installed. The collar location is known and the oil and gas location is identified. Therefore, an operational plan is realized which avoids the drilling of the couplings when parting the casing.

The radial process has specific surface equipment, which is operated with the downhole drilling tools. The primary standard workover or drilling rig is employed to move the radial tools from the surface to the downhole location and return to the surface. The depth of the well will refine the size of the workover or drilling rig to be employed based on a specific well. The radial tool system, surface equipment, is in addition to the standard drilling or workover rig.

In standard practice, the drilling rig is equipped with a drilling mud pump, which has a high volume with pressure levels between 3,000 and 5,000 psi. The high-pressure pump is part of the radial drilling surface equipment. The pump capacity is 20,000 psi. Fluids that are employed onto the radial system must be filtered to particle sizes of less than 5 microns. The high-pressure pump is equipped with bag filters which produce a pumping fluid with particle size less than 5 microns.

The fluids that can be employed in the radial system are water, saltwater, lease water, oil, diesel, acid, or other apparent fluids. In all cases, the fluids must be filtered for high-pressure pumping. The pumping of fluids at high pressure will not accept input of air. The main primer pump must have a system to "bleed" off any air in the system and that the fluid is considered non-compressible. Extra care must be provided to pre-charge the high-pressure pump via a "close loop" pump, which will not allow any air intake. Therefore, the fluid is free of any air and is non-compressible.

The control and operation of the downhole tool requires non-compressible fluids to operate. The pump transfers the fluid to the "work string" via a high-pressure hose. The hose is connected to a high-pressure swivel which allows the "work string" to rotate. The high-pressure pumping system has a safety valve, which prevents excessive pressuring of the system to occur.

The tool is moved to the downhole location via high-pressure tubing (work string), which is connected together via threaded joints. The tubing is of high tensile strength and will have an operating pressure of 20,000 psi. Hence, the fluid pressure is transferred to the borehole location from the surface location. Small pressure drops occur pending the depth of the borehole and oil and gas formation location due to internal friction.

The work string tool joints are larger than the tube but will be of a size to operate through the bore of the casing. For example, the well can be cased with 4½" casing having a 4" ID. The tool joints are 2⅛" in diameter, thus there is sufficient annulus to operate and allow the fluid return to reach the surface.

Typical rotation of the work string is 100 to 150 rpm. At this speed, the tool joints do not cause damage to the ID of casing. The work string has sufficient tension and compression strength to operate the fully automated system. Depending upon the well depth, the work string will stretch or elongate. Special calculations can be provided to determine the stretch of the pipe measure in a unit length. The pipe stretch must be known to locate the downhole tool adjacent to oil and gas formation.

Exact positioning of the downhole tool is accomplished via a "gamma ray" unit. The "gamma ray" tool is a common method to locate tools downhole. Therefore, the radial tool assembly can be operated employing the surface equipment and work string.

The collar logs also identify the area along the axis of the casing where the casing can be parted without any contact with the casing collar. It is imperative that the casing is parted without cutting the casing couplings.

As stated before, the "gamma ray" standard units will allow the operator to know the limits of the formation thereby allowing a drilling plan to be provided.

The drilling of radial boreholes must be conducted in an automatic condition due to the remote location. The drilling system must be programmed and the system must locate, part casing and drill out without surface control. The following is a description of the automatic drilling system:

In order to lock the tool in an operating mode, the tool must be anchored to the sidewalls of the casing. A tool assembly having a double set of slips is engaged and is locked in to anchor the downhole tool. This method is conducted in standard oil and gas operations. Directly above the anchor is a magnetic tool to be used as a metal chips gathering system.

The drilling of the boreholes is conducted in two events, i.e., parting of the casing and drilling of the boreholes. Hence, the casing-parting tool is operated first and the drilling of formation is the second operation. Both are conducted in sequence.

The parting of the casing and the boring of the hole are conducted in two parts but at one time period. A specially designed extension tube is provided. The tube is constructed of NiTi alloy, which allows flexibility in bending and rotating.

The tube is fitted with spheres, which are spaced and fastened to the NiTi tube via electron beam welding process. The spheres serve two functions, i.e., lateral support and a positive movement device for deployment of the extension tube. The special extension tube is rotated allowing the drilling arrangement to be powered for cutting purposes.

The special extension tube is matched via a grooved wheel. The wheel has grooves to accept the size of the sphere. The spacing of the grooves over the wheel is the same cord distance as the location of the sphere mounting location. The grooved wheel is powered by a gear rack assembly. The rack and extension tube is controlled from the surface. The extension tube upstream of the grooved wheel is in tension or neutral not compression as the drill string is lowered. The rack powers the groove wheel thereby causing the extension tube to be moved outward. The spheres are employed to avoid any slippage of the extensions tube or to provide a positive drive at all times.

The extension tube is rotated via the drill string from the surface. Fluid pressure exits the drill string and enters a tailing tube. The tailing tube is connected to the extension tube. The assembly, once activated, is moved through a guide, which is equipped with a low friction material thereby lowering tension drag and torsional drag. The drilling arrangement parts the casing at a rotating speed approximately 50 to 75 rpm. The pressure level is 3500 psi. Once the casing is parted, the pressure is elevated to 20,000 psi and the tool speed of 150 rpm in set.

Once the full length of the extension tube is extended, a weep hole indicates the full extent of the tube movement. Once the hole is bored, the speed is reduced to 50 rpm and pressure is reduced to 3500 psi. The process is complete. The extension tube is retracted from the surface and placed in the stowed location. Once the assembly is in a stowed location, a weep hole is activated thereby indicating the location of the tool in a stowed location.

Due to the oil and gas formation requiring certain direction control of the radial holes, special instruments are indicate the direction of the exit part of the tool.

DETAILED DESCRIPTION OF THE INVENTION

Figure 1:
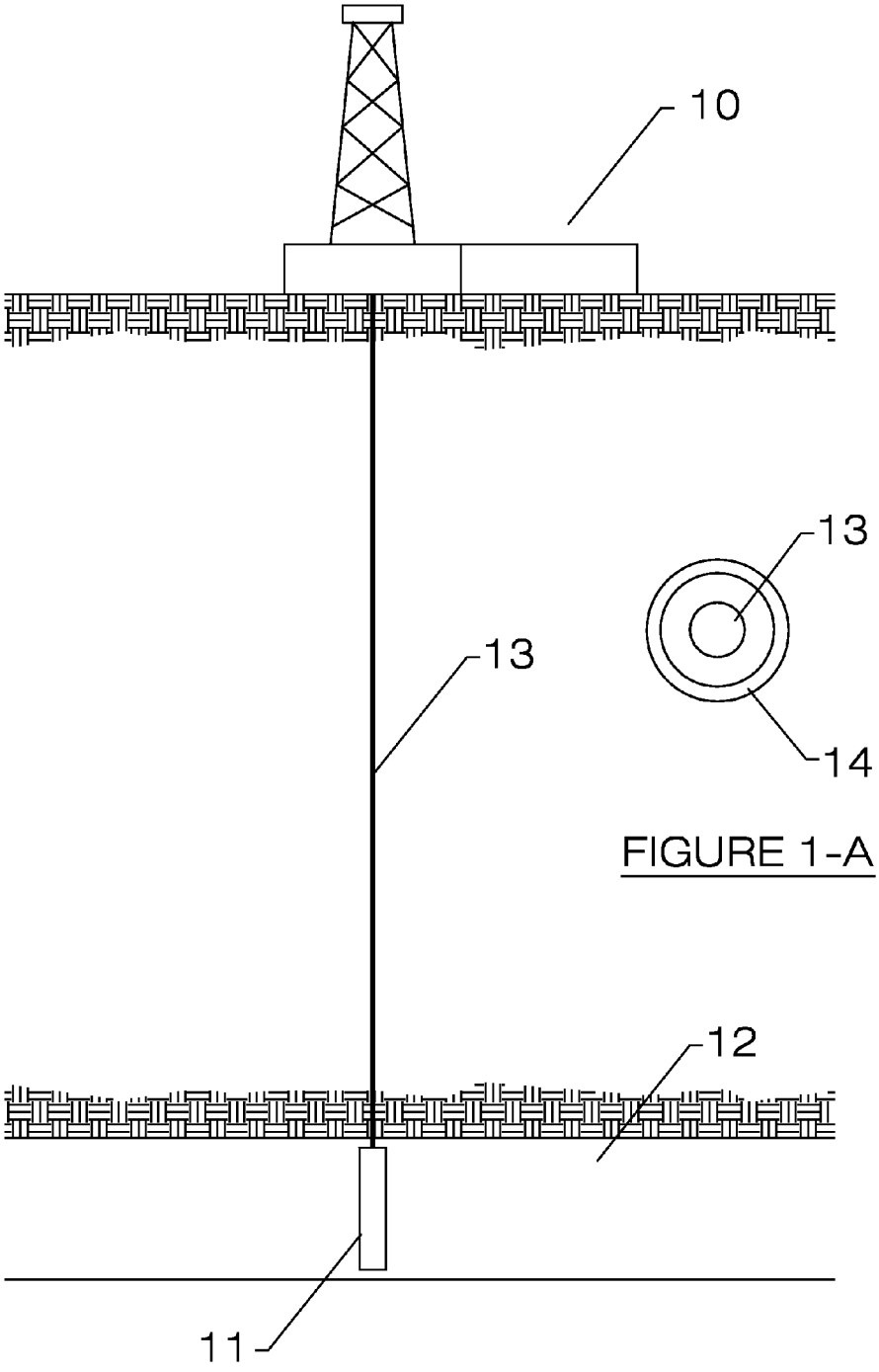
FIG. 1 illustrates the general arrangement of the surface equipment and the downhole tools.

FIG. 1 illustrates the surface equipment 10 and the downhole tools 11. The oil and gas formation 12 is the area of interest regarding the Radial Drilling System.

The downhole tools are connected to the surface equipment by a work string 13. The distance between the surface equipment 10 and the oil and gas formation can be 30,000' maximum and as little as 500'.

The thickness of the formation 12 can be as large as 1,500' and as little as 3'. The oil and gas formation is the area, which the radial tool will be employed.

The original vertical or horizontal borehole is drilled by standard methods and is cased with a steel tube 14 FIG. 1-A, as seen in a sectional view.

The surface equipment is provided to operate the downhole tool 11 from the surface. The work string 13 is the umbilical link between the surface equipment and the downhole radial tools.

FIG. 1-A illustrates the casing 14. The diameter of the casing varies from 4½" through 36" and wall thickness from ¼" to 3". The casing string varies in size from the surface to the formation allowing the larger casing to be shallow and the smallest casing to be at the location of the oil and gas formation.

Figure 2:
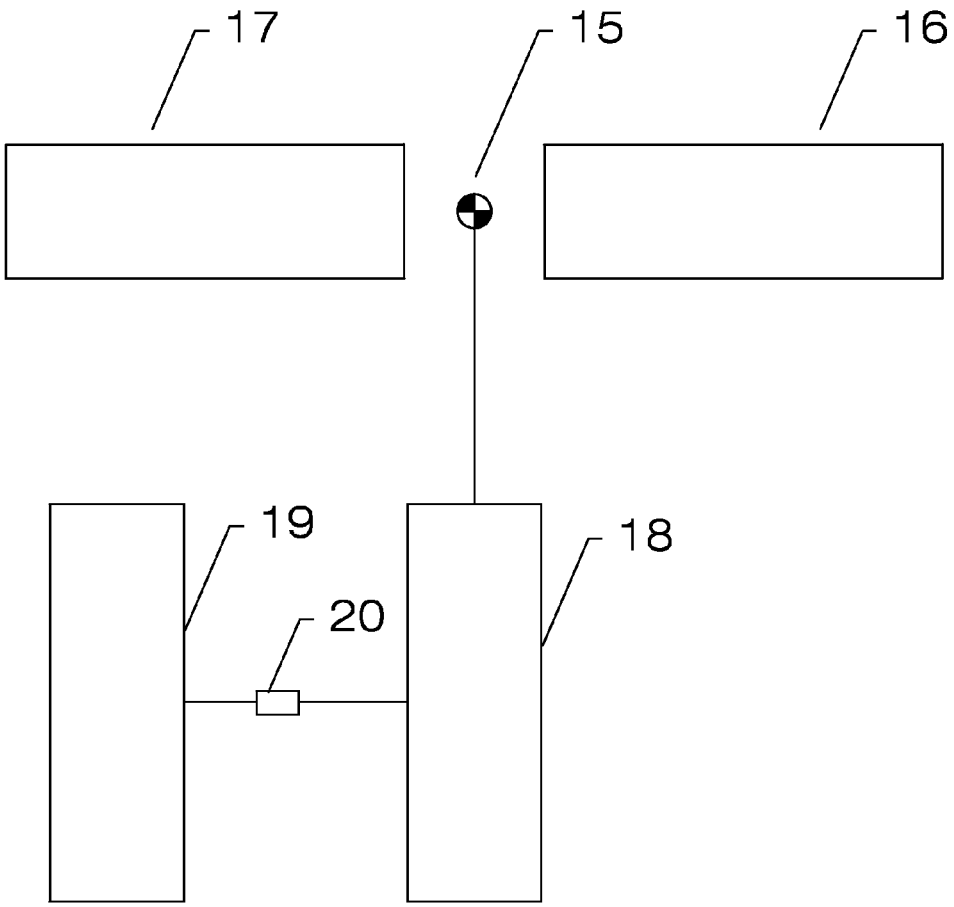
FIG. 2 illustrates a typical layout of surface equipment illustrating the various components.

FIG. 2 illustrates the surface equipment employed in the invention. FIG. 2 illustrates the equipment from a plan view.

The well center 15 illustrates the entrance of the casing and work string to the formation. The workover or drilling rig 16 is used to operate and maneuver the work string in and out of the well.

The pipe rack area 17 is used to marshal pipe once it has been removed from the earth.

The radial unit 18, which houses the controls and pumping system, is mounted adjacent to the well center. Supporting the pumping system is the completion fluid tank 19. The fluid tank contains special operational fluids. The fluids are transferred to the pumping unit 18 via a low pressure pump 20.

Figure 3:
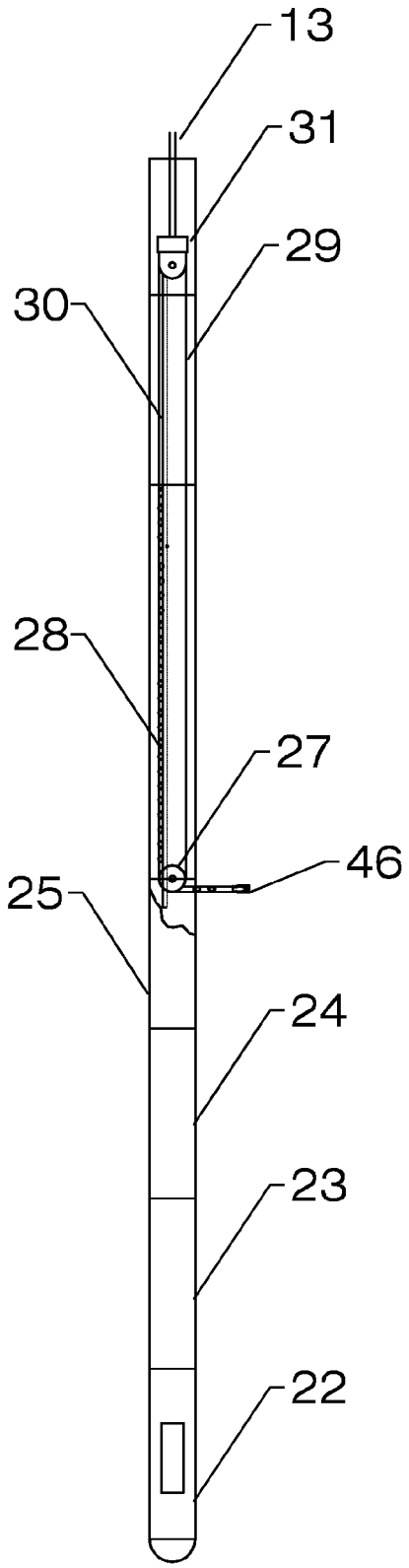
FIG. 3 illustrates the basic components of the downhole tool.

FIG. 3 illustrates the Radial Drilling System and components. The radial tool is a complete system which can locate, anchor, part casing and extend outward to provide lateral holes in an oil and gas formation. The tool is installed into the original borehole via the work string 13. Once the tool has reached the target area, the anchor 22 is engaged and via hardened dies the tool is fixed to the casing. Directly above the anchor 22 is the metal shavings collection component 23. Above the shavings collection component 23 is a protection tube 24, which guards the rack assembly 29, when it is in a fully extended position. Above the protection tube 24 is the external body 25 of the nozzle extension system. Contained in the external body 25 are several components of the radial system.

The rack 29 is attached to the gear head 31 and is engaged into the extension gear wheel 27. The rack 29 has machined teeth on one side of the structural member. The extension wheel 27 is a member that is mounted on bearings and grips the extension tube 30 causing the drilling arrangement 46 to enter the oil and gas formation.

Figure 4:
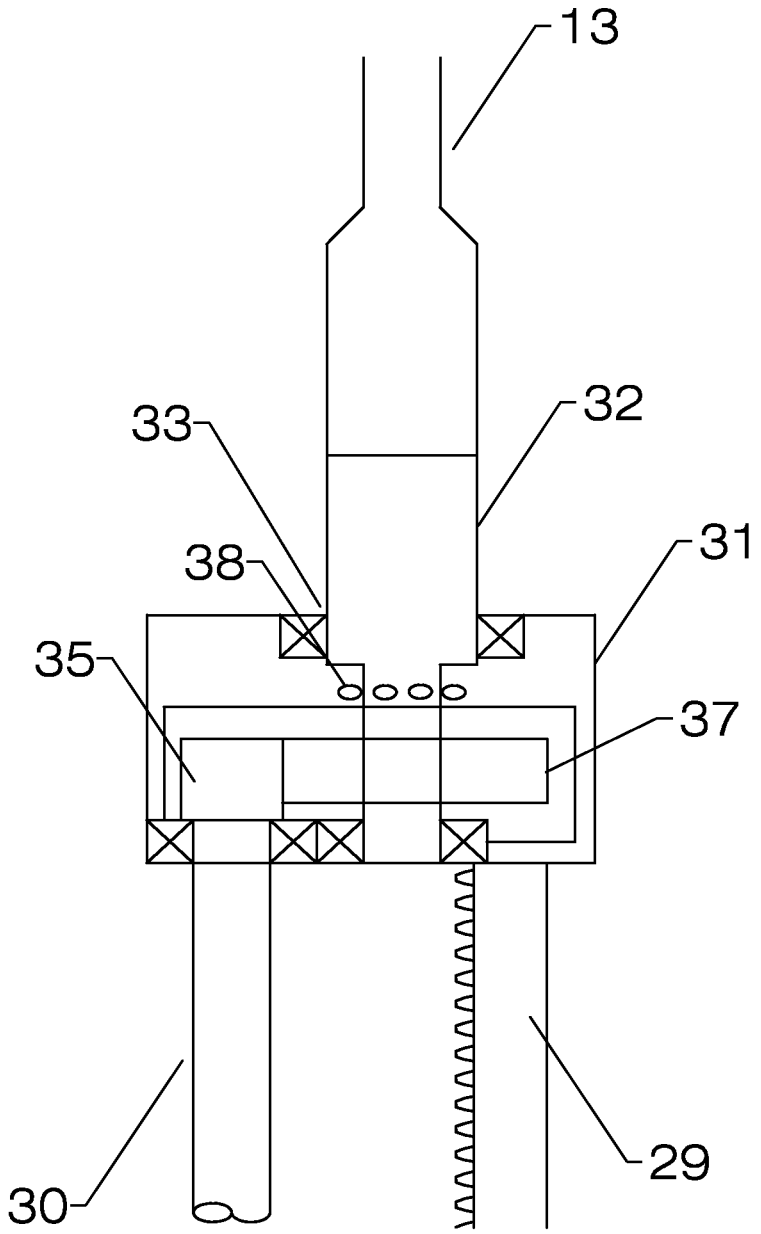
FIG. 4 illustrates the extension drive assembly.

FIG. 4 illustrates the high-pressure gear rack device. Power is transmitted to the gear head via the work string 13. A sub 32 accepts the power transmitted from the work string. A spur gear 37 is mounted about the sub 32. Sub 32 is supported by special bearings and seals 33. An output shaft 30 accepts the power from the spur gear 37 via a gear 35. The gear 35 is fastened to the output shaft/extension tube 30. The gear head enclosure 31 is sealed to withstand a working pressure of 20,000 psi through the fluid passage 38.

A gear rack assembly 29 has a double gear rack attached to the underside of the annulus. The gear rack 29 extends to the extension wheel and when the vertical movement occurs, the racks provide rotation of the wheel. The complete assembly is timed to prevent the extension tube 30 to be subjected to a compression force.

The gear head assembly, its power input and power output, has been designed to operate the extension tube and the cutting nozzle. The general operation of the unit allows the power to be accepted by the gear head assembly 31 via the work string 13. The speed and internal pressure is controlled from the surface. As the decision to part the casing and construct the radial borehole is made, a fluid pressure of 3,500 psi. is established. The work string rotation is set between 75 and 90 rpm. The drilling of the casing is conducted either manually or via an automatic feed device.

The movement of the drilling arrangement will be 2" measured axially along the extension tube. Once the casing has been parted, the power is elevated to 20,000 psi surface pressure and the rotation are increased to 250 rpm. The oil and gas formation is being drilled at a rate pre-determined and with relationship to the strength of the rock foundation. Depending upon the strength, the drilling of the radial holes is timed. Once the extension tube 30 reaches the extent of the length, a pressure valve is opened thereby bypassing the fluid and illustrating a sharp drop in the system pressure.

The pressure drop alerts the operator that the extension tube is in its furthest outbound position. The operation reduces the pump pressure to 3,500 psi and the rotating speed of the extension tube 30 to 75 rpm. The operational or automatic feeding unit retracts the extension tube and nozzle.

Once the extension tool is retracted, a valve is opened illustrating to the operator that the extension tube is in a stowed position. The operator then reduces the pump pressure to zero and the rotation to zero. The operator unlocks the anchor and moves the tools to a new location.

Figure 5:
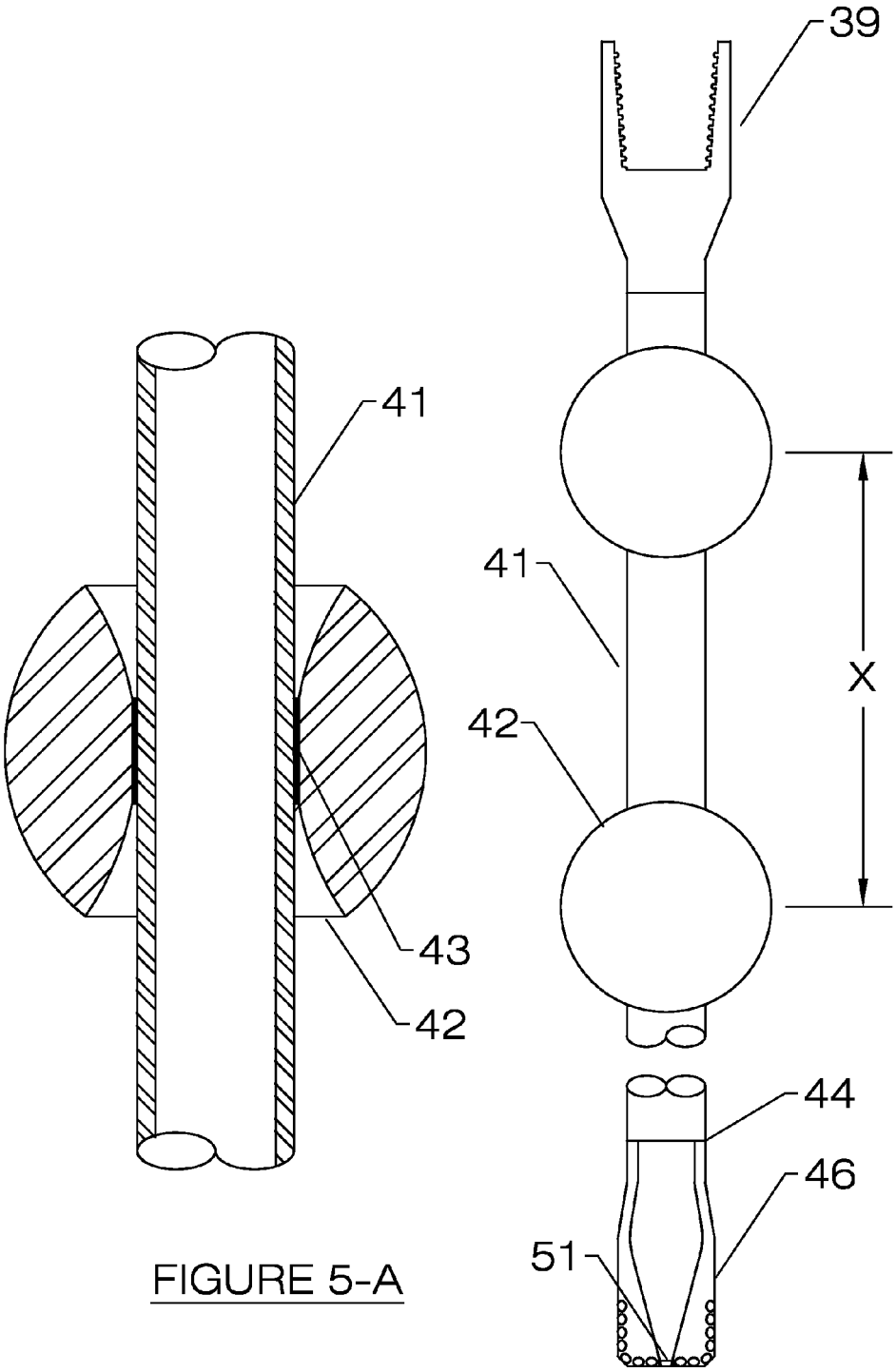
FIG. 5 illustrates the extension tube with lateral support spheres.

FIG. 5 illustrates the construction of the extension tube and the stabilizer spheres. The tube 41 is attached to a threaded joint 39 via a weldment. The weldment employs an electron beam welding system. The tube is NiTi (nitinol) alloy. The electron beam welding system does not require "filler materials". The electron beam welding method provides a very small heat effective zone, thereby providing that a weldment has the same physical and chemical properties as the base tube material.

The opposite end of the NiTi tube is a welded connection, which provides a female threaded member. The same electron beam welding system is employed. The threaded connection has a transition area, which causes a method to disperse the bending stress level at the connection. The threaded connection 44 accepts a drilling arrangement unit via the threaded connection. Internally of the threaded connection is a jet opening 46. The jet opening is fitted with a sapphire stone with a specific nozzle size.

The extension tube 41 is fitted with a spherical member 42 about the basic tube 41. The spherical members are attached to the tube via an electron beam weldment. The internal surface of the spherical stabilizers 42 have a curved surface with allows the ID of the spherical stabilizer 42 to make contact with the extension tube at a low contact area. The contact point is the electron beam weldment as illustrated in 43.

The spherical stabilizers can be rotated and "pulled" without detachment from the extension tube 41. The placement of the spherical stabilizer 42 along the axis of the tube 41 is specific. The spherical stabilizers are placed at an exact distance to allow the extension wheel to function. The drilling arrangement unit has PDC inserts mounted in a form to allow machining of the casing and cutting of the oil and gas formation. Replacement of the drilling arrangement is conducted by unscrewing the head from the extension tube body 41. The tube and threaded connection are constructed in one length.

Figure 6:
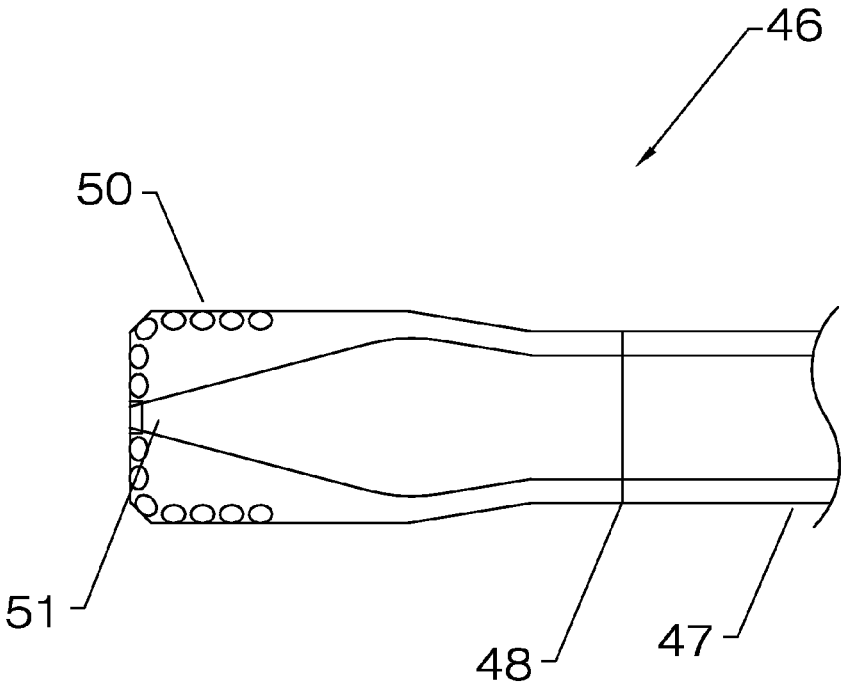
FIG. 6 illustrates the drilling system boring unit employing high-pressure jetting action and PDC cutter.

FIG. 6 illustrates the drilling arrangement assembly 46, which has been designed to part the casing and drill the formation. The dual-purpose device is novel and is an important area of this invention. The threaded assembly 48 is welded to the extension tube at 47. Due to the high rotational speed, the tube and mill/bit assembly must be in line no more than 0.0005" eccentricity.

The drilling arrangement is equipped with PDC cutter and an internal high-pressure nozzle 51. The nozzles have one orifice, which is protected via a sapphire stone. The nozzle "up ramp" considering a focus jet action which is directed to the center of the bit. Steel milling cutters are designed to perform with metallic materials. Hence, any steel machining arrangement would cut the casing 14. However, once the casing has been parted into a borehole is drilled in the formation is required.

PDC (stabilized) inserts have caused great improvement in the drilling of oil and gas wells. FIG. 6 illustrates a typical bull nose metal machinery bit. Item 50 illustrates a typical PDC arrangement regarding a bit to drill oil and gas formations. A combination of milling cutters and formation cutters are included in the drilling arrangement design. The machining of the steel and the formation are considered to be classed as a "shaving" operation. Hence, a specific "layer" of material is removed with respect to each reduction. Hence, small quantities of vertical (normal) load are necessary for cutting the casing or the formation. The arrangement of cutters is novel regarding the drilling arrangement 46 unit.

Figure 7:
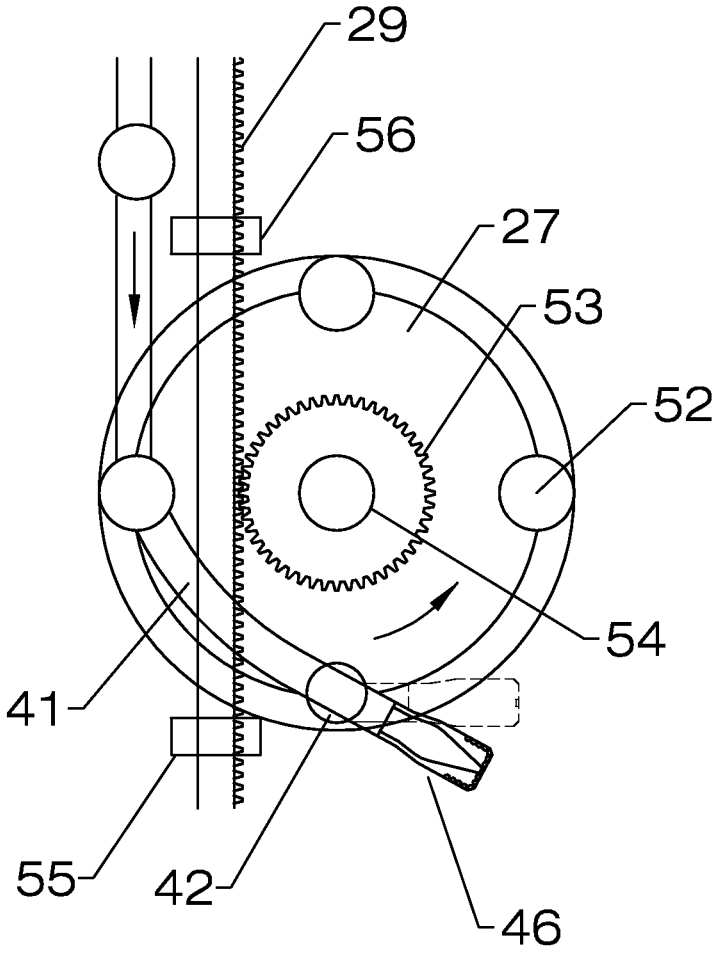
FIG. 7 illustrates the nozzle extension tube, nozzle and drive wheel.

FIG. 7 illustrates the extension wheel 27. The design requires that the extension tube be operated in which the tube area above the extension wheel 27 is in tension at all times. As the gear rack 29 is pushed downward, the pinion 53 is rotated causing the movement of the extension tube 41; thereby, entering the formation. The extension tube, which is outbound of the extension wheel, is in compression. The extension tube that is fitted with spherical stabilizers 42 protects the NiTi tube 41 from buckling under compressive loading. As the extension wheel is rotated via the gear rack assembly 29, the grooves grip the spherical stabilizer 42 and move the assembly outward at a positive rate without slippage. The extension wheel is mounted on a suitable bearing to maintain centerline of the tool.

Figure 8:
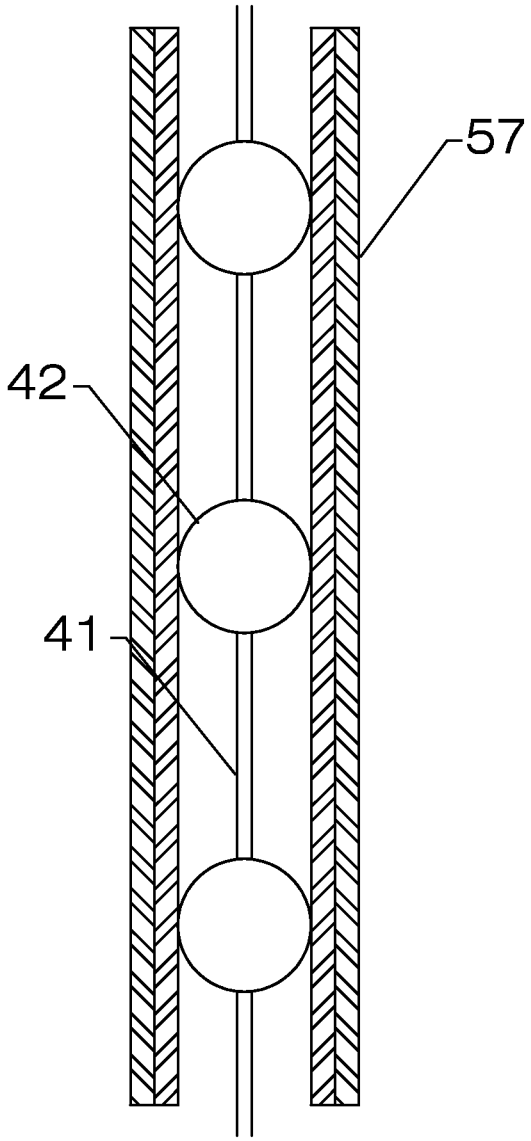
FIG. 8 illustrates the extension tube, guide tube and low friction buffer tube.

FIG. 8 illustrates the extension tube guide. The extension tube 41 is fitted with spherical members 42 along its axis. The extension tube will be subjected to tension loading and torsional loading. The speed ranges of the extension tube are 50 rpm minimum, 250 rpm maximum. It is necessary that friction is reduced. The extension tube 41 is guided by a protected tube 57. The inside of the guide tube is fitted with a very low level of friction material such as UHMW. The combination allows rotation and axial movement with a minimum drag.

Figure 9:
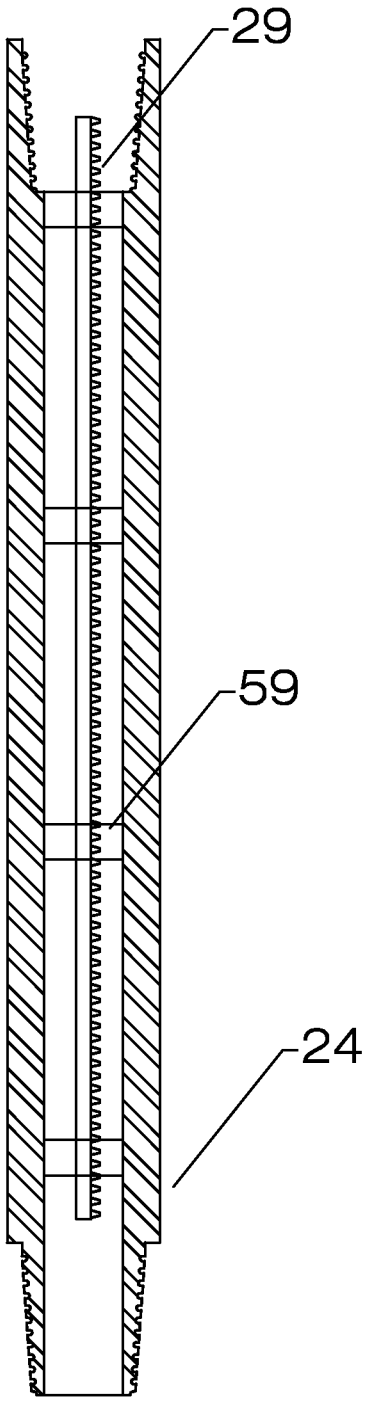
FIG. 9 illustrates the rack extension tube.

FIG. 9 illustrates the rack protective casing 24. The protective casing is equipped with guides 59, which support and marshals the racks. The length of the protective casing is +two feet longer than the rack assembly.

Figure 10:
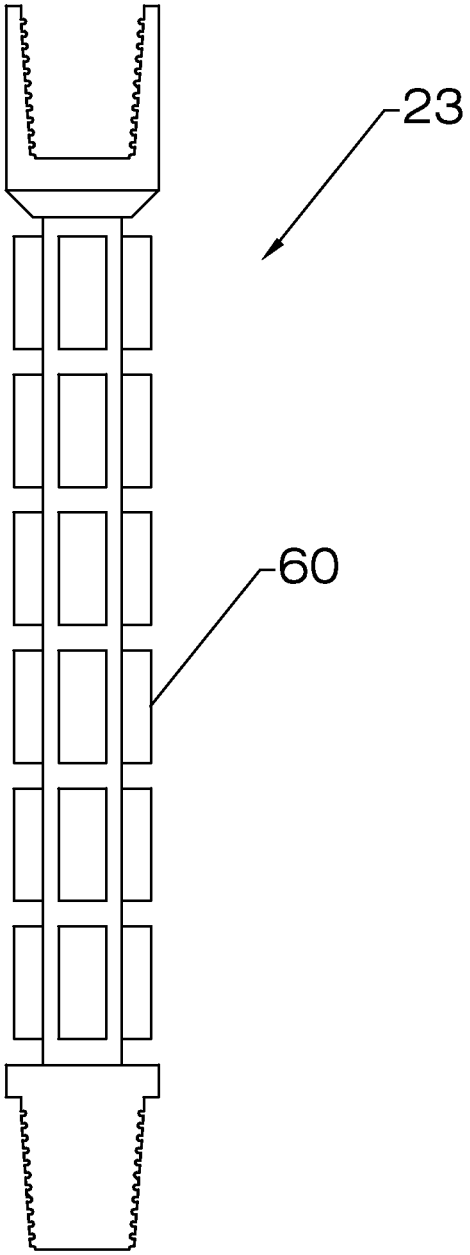
FIG. 10 illustrates the magnetic hole cleaner.

FIG. 10 illustrates a hole cleaning component 23. The component is designed to gather all metallic shavings, which are produced by the casing parting action. Particles or shavings from the milling operation can cause a malfunction of other mechanical tools in the borehole. The tool component is cleared during each trip in the borehole. The magnets 60 are replaceable.

Figure 11:
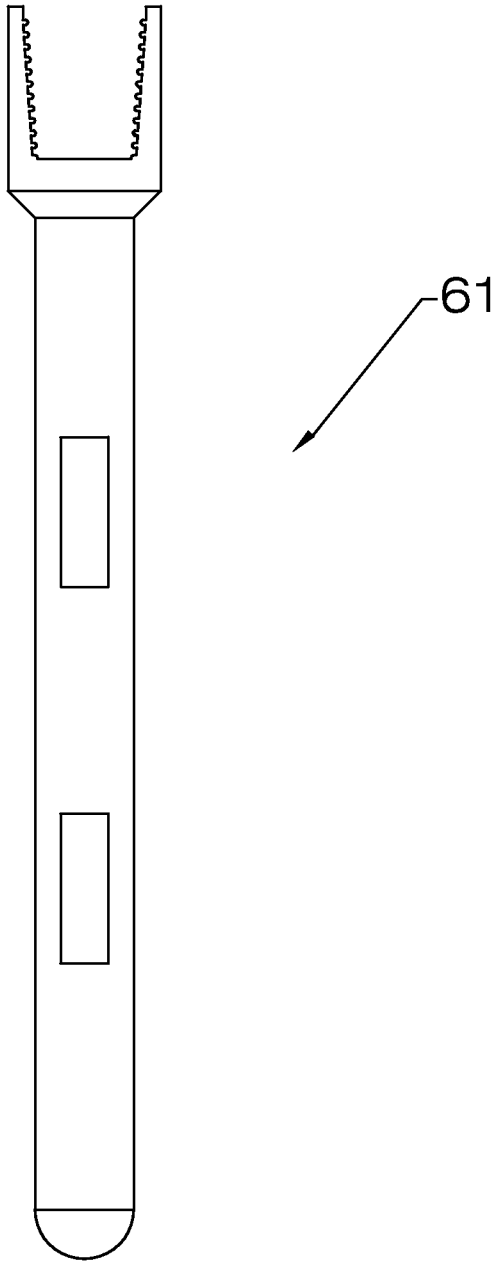
FIG. 11 illustrates the tool anchoring system.

FIG. 11 is a typical standard anchor 61, which attaches the radial tool to the casing via quick setting drive. This assembly is part of the standard radial tool but is a commercial product.

Figure 12:
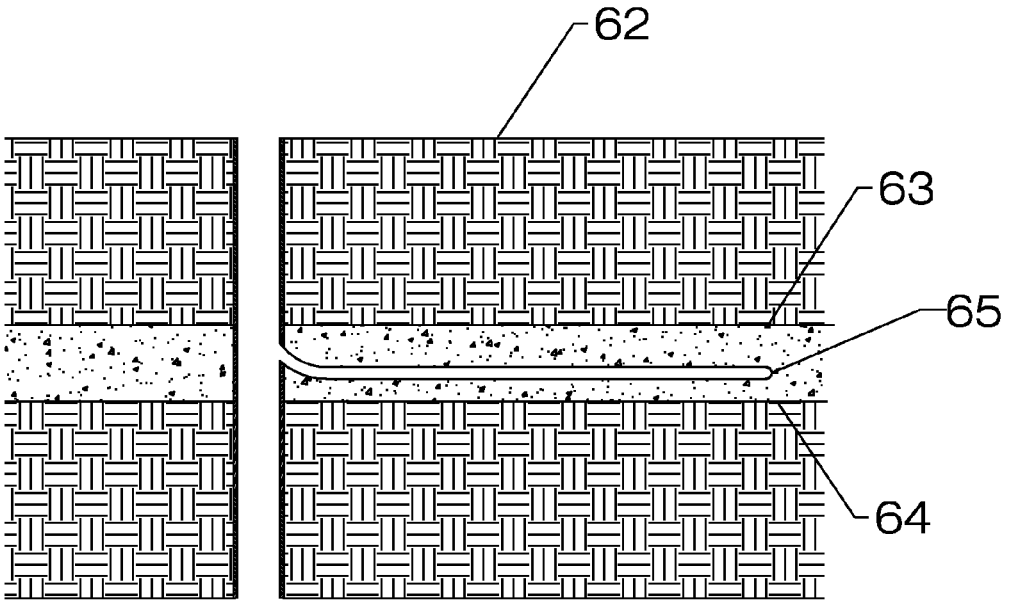
FIG. 12 illustrates an oil and gas formation which requires radial boreholes in thin seams.

FIG. 12 illustrates a completed radial borehole located in a thin formation. The surface 62 is illustrated were the support equipment is located. The formation upper level 63 and the formation lower level 64 defines a thin formation, i.e. 3'-6" The completed borehole 65 is illustrated.

GENERAL FIELD OPERATIONS OF THE INVENTION

The oil and gas reserves have been deposited over millions of years in specific layers. The formation layers are of varying thicknesses ranging from 2' to 2,000'. The formations are produced employing a method known as perforation. Explosive charges are employed to part the casing and extend outward several inches into the formation. There are many disadvantages to this process.

Horizontal drilling is employed which allows a borehole to be extended employing a "turn" from vertical to horizontal in a 100' or more radial pattern. Formations made of small thickness cannot support horizontal drilling.

In order to harvest oil and gas reserves from thin seams, the radial invention has been developed. Due to the design, the radial system does not require a radius to translate a vertical borehole to a horizontal borehole. The radial system departs the casing at 90 degrees, directly into the oil and gas formations. The size and length of the radial borehole is predetermined.

The following is the work procedures concerning the development of radial boreholes in oil and gas formations:

Procedure 1

Surface equipment 10, FIG. 1, is mobilized about a typical well location.

Procedure 2

The support components are arranged about the well center as illustrated in FIG. 2. The workover Rig 16 is placed adjacent to the well center 15. The radial tool control console is also placed adjacent to the well center. The fluid tank 19 and transfer pump 20 is placed adjacent to the radial tool control unit.

Procedure 3

The downhole radial tool illustrated in FIG. 3 is lowered into the well bore via a tubular work string.

Procedure 4

A gamma ray instrument is employed to place the exit drilling arrangement 26 at the formation to be serviced. Once the location is identified, the tool anchor 22 is set; thereby locating the tool with relation to the formation.

Procedure 5

The work string extends above the workover rig 16 drill floor. A connection of the rig's power swivel is made to the workstring. The pressure pump located on the radial support unit is elevated to 3,500 psi. The system is pumped until circulation is determined at the surface.

Procedure 6

Once circulation is established at the surface, the power swivel is engaged and the speed is adjusted to 75 rpm. The torque ready is observed.

Procedure 7

Once the 3,500 psi pressure is attained, a pressure lock is released, disconnecting the extension tool assembly from the radial tool body.

Procedure 8

The workstring is lowered causing a compressive load to be placed onto the drilling arrangement 26. The drilling arrangement 26 cuts the steel casing to a specific size and depth.

Procedure 9

Once the casing milling is complete, a drop in torsion is observed. Also, a drop in pressure is observed once the extension tube has advanced 5".

Procedure 10

Once the initial casing is parted, the pumping pressure is elevated to 20,000 psi and the rotational speed is increased to 150 rpm.

Procedure 11

Once the formation drilling conditions are met, the workstring is lowered at a rate which has been preset regarding the harness of the formation.

Procedure 12

The drilling arrangement 26 is extended outward to the designed tube length. Once the extension is completed, a valve is opened (weep hole) indicating that the full length has been reached (pressure drop indicator).

Procedure 13

Once the extension tube is extended, the pump system provides fluids to clear the radial borehole, allowing the cuttings to be transmitted to the surface.

Procedure 14

Once the radial borehole is cleared of cuttings, the workstring is retracted pulling the extension tube into the original stowed location.

Procedure 15

The goals of the radial tool are to provide completed boreholes as shown in FIG. 12. The boreholes can be placed in several series and groups. The drilling plan will allow radial holes located at the most efficient areas with respect to oil and gas production.

Procedure 16

Thick formation forms, 12'-300', can also be serviced by the radial tool. Depending on the residual oil and gas quantities, several radial holes can be constructed and placed in any direction.

What is claimed is:

1. A drilling system to produce lateral boreholes comprising:

a downhole tool sized to accommodate standard oil and gas casing, wherein the lateral boreholes are formed by a cutting arrangement which allows the casing to be parted employing surface of a cutting tool to be compatible with steel or metallic material forming an opening;

a jetting system allows the boreholes to be formed by high-pressure jet actions into formation, wherein the cutting arrangement also assists the jetting nozzle to form the lateral boreholes into the formation;

an extension tube and cutting nozzle arrangement is rotated from the surface or a downhole motor allowing variable speeds to be provided for parting the casing and drilling of the lateral boreholes, wherein the extension tube is constructed of a memory material allowing the extension tube to be bend around a drive wheel and rotated and maintaining an original shape of the extension tube once drilling load is removed.

2. The system as set forth in claim 1 whereby both the casing is parted and the lateral boreholes into the formation is provided in one trip from the surface to the downhole formation.

3. The drilling system as set forth in claim 1 further comprising at least one special extension tube withstanding ultra-high internal pressures and is equipped with lateral stabilizers allowing the tube to be placed in an axial compression condition.

4. The system as set forth in claim 1, wherein the memory material is a nickel titanium (NiTi) alloy.

5. The system as set forth in claim 1 provides a means for rotating the extension tube outward into the formation under control and without slippage of the extension tube.

6. The system as set forth in claim 1 provides a means for maintaining the extension tube to be in tension at all times prior to being introduced to the drive wheel.

7. The system as set forth in claim 1 provides an exit from the extension tube at an acute angle.

8. The system as set forth in claim 1 provides a means for directing the lateral boreholes to a specific direction.

9. The system as set forth in claim 8 allows the lateral boreholes to be provided at the specific direction at the same time into the formation.

* * * * *